US005542709A

United States Patent [19]

Evans

[11] Patent Number: 5,542,709

[45] Date of Patent: Aug. 6, 1996

[54] COLLECTIBLE CARDS AND DISPLAYS FOR SAME

[76] Inventor: Donald P. Evans, P.O. Box 447, Pleasant Hill, Ohio 45359

[21] Appl. No.: 283,352

[22] Filed: Aug. 1, 1994

[51] Int. Cl.[6] ..... B42D 15/00

[52] U.S. Cl. ..... 283/61; 283/117

[58] Field of Search ..... 283/117, 65, 116, 283/56, 62, 61, 43; 40/152, 156, 124, 124.2, 124.4

[56] References Cited

U.S. PATENT DOCUMENTS

| | | | |
|---|---|---|---|
| 2,529,151 | 11/1950 | Glass et al. | 283/117 X |
| 4,979,324 | 12/1990 | Rehtmeyer et al. | 283/117 X |
| 5,257,823 | 11/1993 | Colvin, Jr. et al. | 283/117 |
| 5,303,957 | 4/1994 | Barreca et al. | 283/117 |
| 5,318,327 | 7/1994 | Daneshvar | 283/117 |

*Primary Examiner*—Willman Fridie, Jr.
*Attorney, Agent, or Firm*—Jos. G. Nauman

[57] ABSTRACT

Individual stylized articles are provided in the form of collectible cards, or display holders for such cards. The articles may be used as stand alone units to present a single collectible card, and are designed so as to be temporarily attached to each other in configurations of choice, and readily assembled and re-assembled to present different arrangements, such as a group of pictures of a team. The article design is applicable to cards showing players from many different sports, for example football, basketball, baseball, hockey, soccer, etc., and allows the collector to group the cards of his favorite players, as in assembling an "all-star" team, or members of a well known team. The unique articles, whether as cards or as holders for standard cards, are formed from assembled panels of paperboard or the like, selectively attached to define egress slots for inserting/removing standard cards from the holder, and have slot-like formations about their perimeter to provide for temporary linking or attachment of the articles to each other so as to afford collectors an opportunity to group, re-group, and display collections of such cards. Various supporting base structures are also provided for free standing or hanging of the assembled displays.

12 Claims, 8 Drawing Sheets

COLLECTIBLE CARDS AND DISPLAYS FOR SAME

FIELD OF THE INVENTION

This invention relates to collectible cards depicting, in particular, various sports personnel, and to various means for display of same. The cards are usually personalized, and normally bear representations of, and information about, famous sports players. Such cards are of the type commonly issued and traded by sports fans. The unique card configurations, and display holders for the cards, as provided by the invention permit both individual and grouped display of such cards.

BACKGROUND OF THE INVENTION

Display frames have been known for many years, for example the multi-ply paperboard holders (easels) provided by portrait photographers or photographic shops to hold and display photographic prints in an economical way. Such holders are typically single photo units and, as far as can be determined, although a group of photos may be combined in a multi-aperture mat fitted to a single holder, no provision has been made for linking or temporarily attaching multiples of single display holders to provide a group display. Neither has there been any provision whereby such collectible cards might be free standing.

Cards are often merchandised as part of a product package, e.g. chewing gum or other edible products, and the card is simply a flat single panel of paperboard or the like, printed with a depiction of a noted sports person on one side, and with information about that person (teams associated with, statistics, honors received). While the cards so merchandised might be more elaborate, that contributes to their expense and contrasts with the low cost, high volume merchandising effort in which the cards are often used. Sports card collectors have used various plaques or boards to hold groups of cards so the cards can be observed in a common display, but in general such displays rely on merely laying the cards upon a flat surface of a display board. There is no provision for temporary attachment according to choice of grouping, and no provision for presenting the groups of cards in stand up or hang up assembly.

SUMMARY OF THE INVENTION

The present invention provides unique individual, preferably stylized card holders in the form of stand alone units to present a single card. Alternatively the card holders may actually incorporate the usual depictions of collectible cards themselves. The cards/holders are thus referred to hereinafter as articles. The holder and/or card may be readily assembled and re-assembled to present different depictions or arrangements, such as a group of pictures of a team. The invention is applicable to cards showing players from many different sports, for example football, basketball, baseball, hockey, soccer, etc., and allow the collector to group the cards of his favorite players, as in assembling an "all-star" team, or members of a well known team. In conjunction with the unique display holders, a novel multi-purpose base is provided which can support a grouping of collectible cards or holders, according to the invention, in either stand-alone or hang-up modes.

The basic novel card holder (or card if specially printed) comprises two or more panels of a relatively stiff material, such as paperboard, which may be printed with either generic or specialized player configurations (baseball pitcher, catcher, fielder; football lineman, running back, quarterback; basketball forward, center, guard; soccer fullback, striker, goalkeeper), or position names, team names etc. It is within the purview of the invention to have the unique depiction and description of notable sports persons printed directly on such panels, rather than more generic information, in which case the articles can be merchandised in lieu of the present collectible cards.

For example, a preferred embodiment of the novel card holder is formed from a unitary blank having three fold-over plies which form a front, back, and center panel and are adhered together forming a frame pocket or holding space with passages for insertion/removal of a card from either top or bottom directions. When so inserted and aligned, the picture on the collectible card cover the "generic" depiction on the center panel which is viewed when the holder is empty. In this embodiment, all printing for the exterior of the holder can be done one side of the blank. As mentioned, the printed information can be specific rather than generic.

The single cards or holders can be used in a stand-alone configuration or, as is more likely, they may be grouped according to choices of the user. The cards and/or holders include edge configurations between the several panels which allow linking them one to another, as in side-by-side or pyramid style displays, and such displays can be supported on the provided multi-purpose base, allowing the entire display to be hung, or to stand as assembled.

Another embodiment of card and/or holder can be formed of two folded-over panels which are adhered to form front and back panels with the holding space between them. In this embodiment, printing can be done on both sides of the somewhat smaller blank. Further embodiments may include replaceable parts to depict different headgear (helmets) or other parts.

The several embodiments provide a choice between economy of material and/or manufacture, and between more or less elaborate cards and/or holders.

The principal object of the invention is to provide a unique card design and a unique display holder for collectible trading cards, such as used to depict sports personalities, whereby the cards may be displayed individually, or in a special holder, and whereby they have provision for temporary linking or attachment to each other so as to afford collectors an opportunity to group, re-group, and display collections of such cards; and to provide a multi-purpose base which can support the assembled cards in different modes.

Other objects and advantages of the invention will be apparent from the following detailed description, the accompanying drawings, and the claims.

DESCRIPTION OF THE PREFERRED EMBODIMENT

Figure 1:
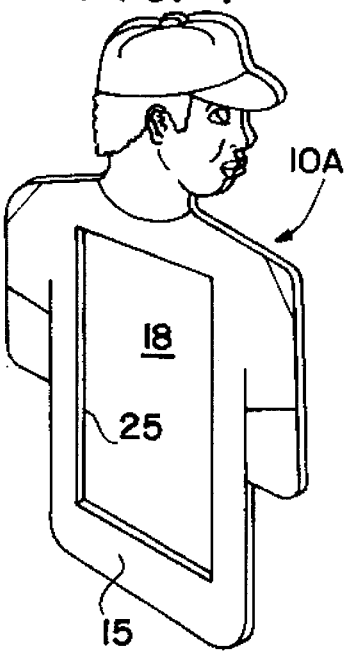
FIG. 1 is a perspective view of a multi-ply display holder for a sports card, constructed according to the invention.
Figure 2:
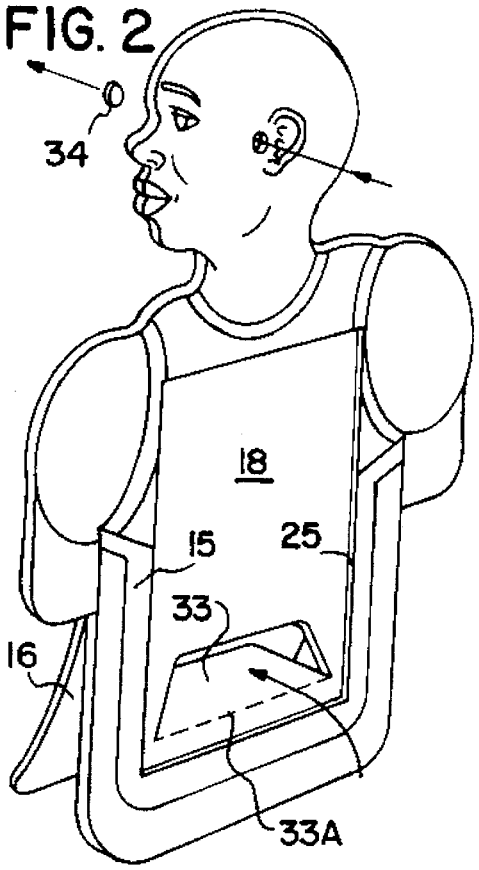
FIG. 2 is a perspective view of a different configuration of a card holder, emphasizing the holder's stand-alone and hang-up capabilities.
Figure 5:
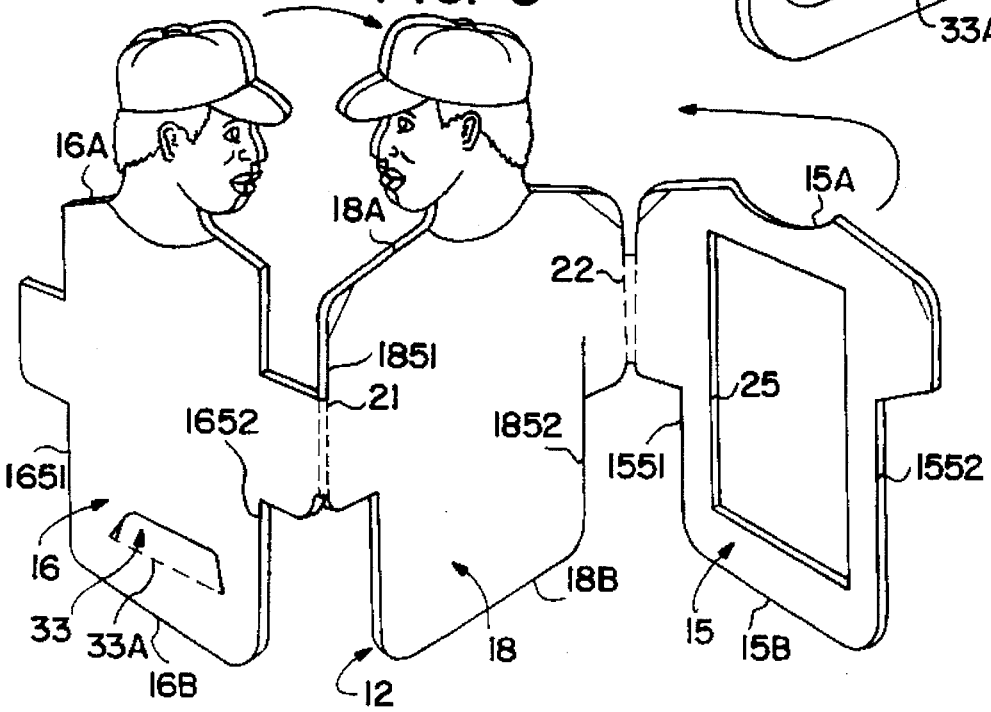
FIG. 5 is a perspective view of the three panel blank, showing the steps of assembling the holder from the three panel blank.

Referring to FIGS. 1 and 2, a single article 10A, which may be either a display holder for a collectible card, or such a card itself, built according to the invention, is illustrated in the form of a three-part blank 12 of material which is die cut (or similarly formed) from rigid or semi-rigid material, such as paperboard, a thin plastic, or a cardboard/plastic laminate. A preferred material is a paperboard card stock, which may have multiple plies, may have a coating on at least one surface, and which is of a type commonly used for packaging as well as various cards, particularly collectible sports cards. It is also possible to use thin molded plastic parts.

The blank is divided roughly into a front panel 15, a back panel 16, and a center panel 18. Each of these panels has a top 15A, 16A, 18A, a bottom 15B, 16B, 18B, and sides 15S1 and 15S2, 16S1 and 16S2, and 18S1 and 18S2. The panels 15, 16 and 18 are integrally joined along fold lines 21 and 22. The front panel is provided with an aperture or opening 25 sized to conform to the viewing area of well known sports cards.

Figure 3:
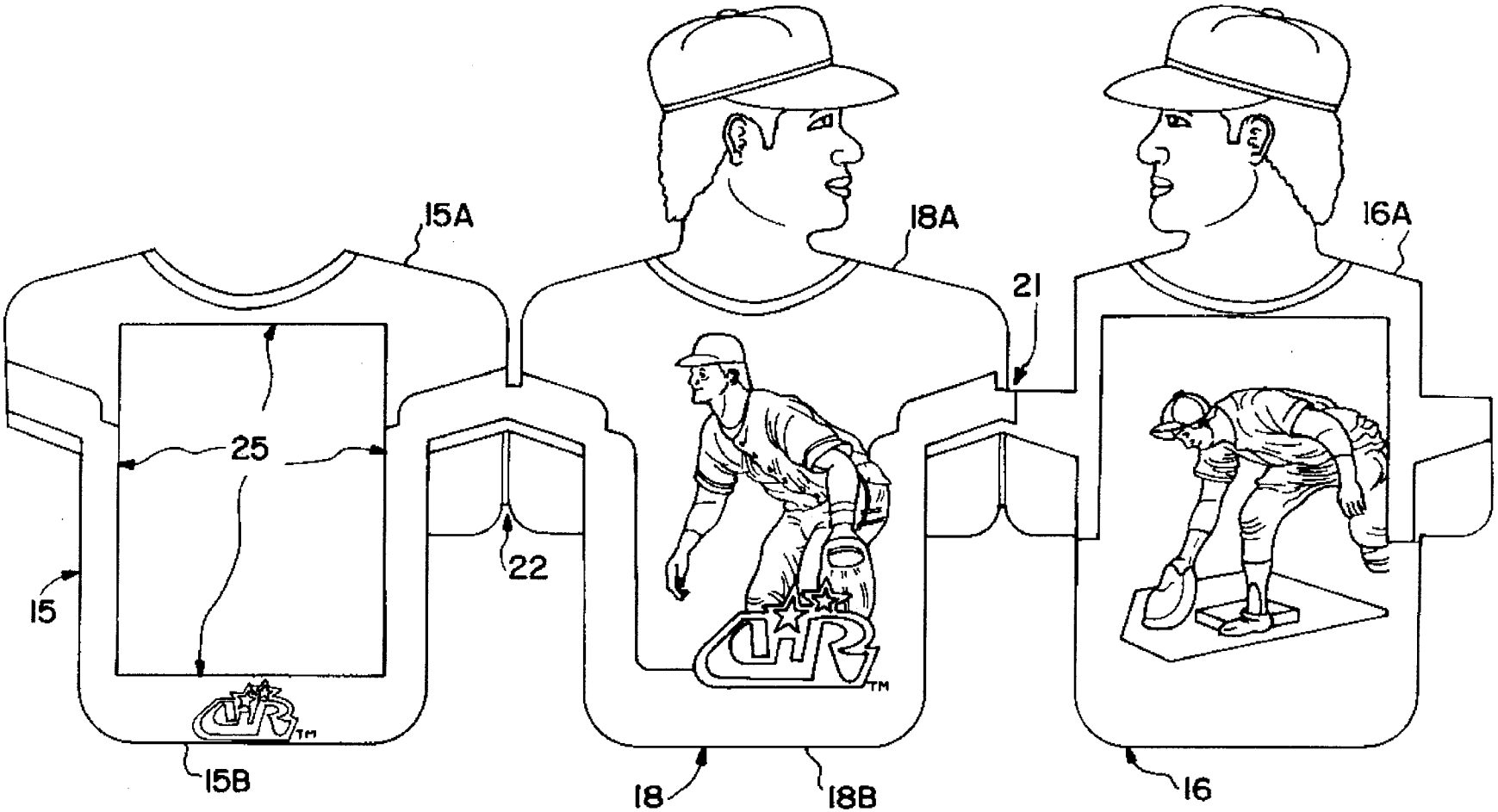
FIG. 3 is a front plan view illustrating a three panel blank of card stock, prior to assembly into the display holder.

By applying a pattern 28 of suitable adhesive to the plies (see FIG. 3), or by heat sealing plastic in such a pattern, the back panel 16 is folded onto and fastened to pictorial information may be a depiction of an actual sports personage, and data about that person may be printed on the center panel 18 (for example) in place of the generic depiction shown in FIG. 3.

A two panel embodiment is also possible, in which the front panel 15 is omitted, and the central panel 18 is selectively fastened (as by adhesive) to the back panel 16. In such embodiment, it is desirable to print on both sides of the blank, so the face and head caricature appears on the front of such holder, as well as on its rear face. While this embodiment requires somewhat less material, the printing and application of adhesive is more complicated.

An optional flap 33 (FIGS. 2–5) can be formed in rear panel 16, and folded about its hinge or fold line connection 33A, to spread the bottom edges 18B and 16B, allowing the display holder to be free standing, as in FIG. 2. Also, FIG. 2 shows a small scored circle of material 34 in the "head" configuration, which circle can be removed (punched out) as shown to admit a mounting pin or the like (not shown).

Figure 4:
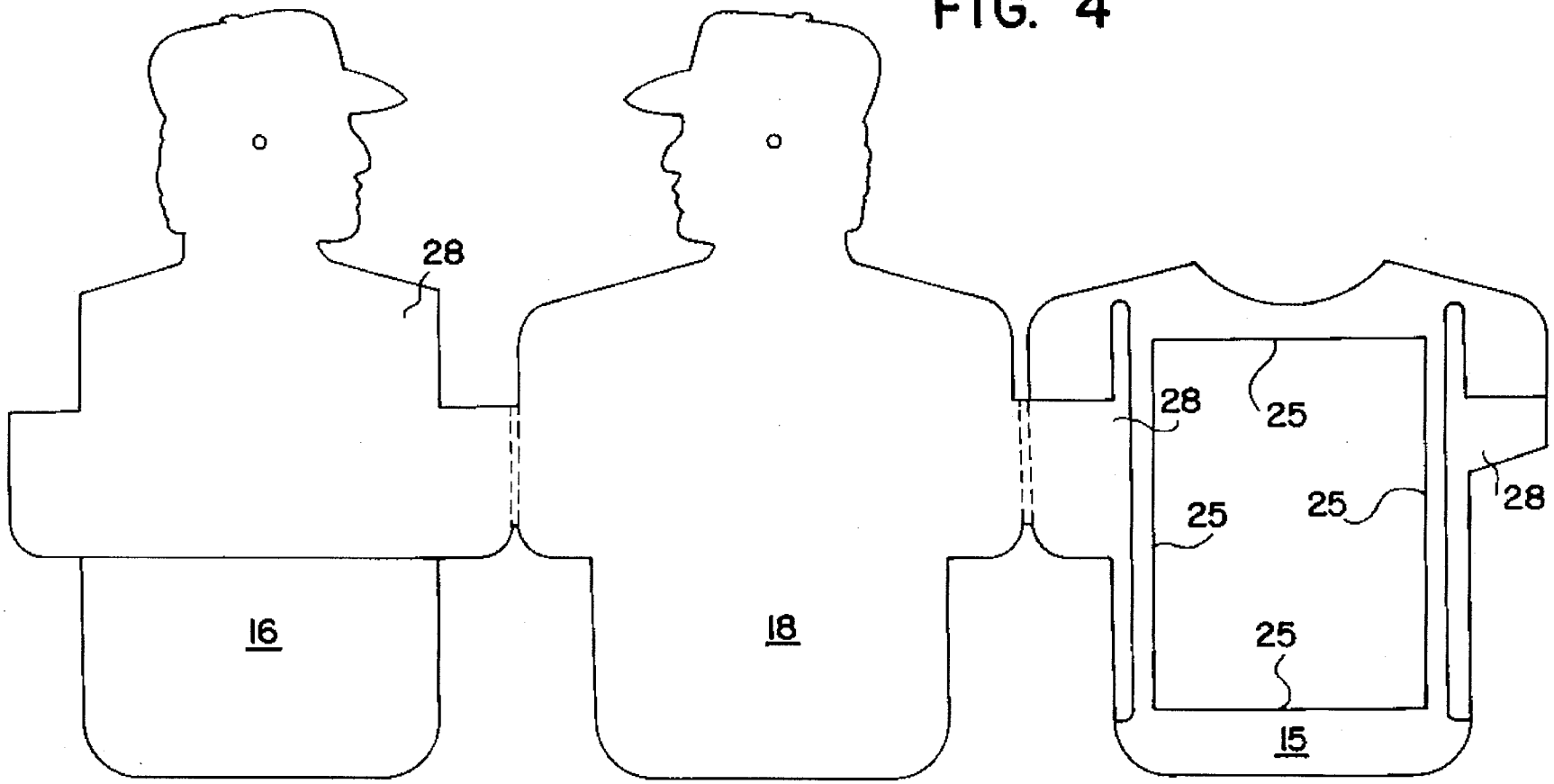
FIG. 4 is a rear plan view of the three panel blank, showing the patterns of adhesive by which the panels are joined.
Figure 8:
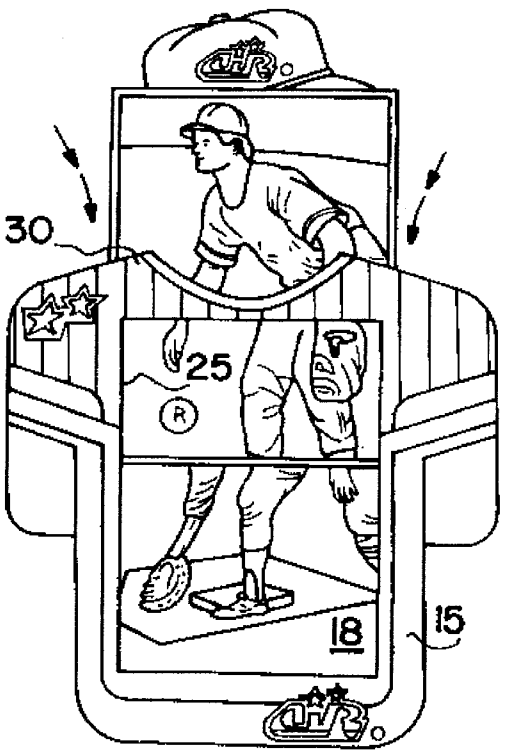
FIGS. 6, 7 and 8 shows typical collectible cards being placed into and removed from the display holder.
Figure 7:
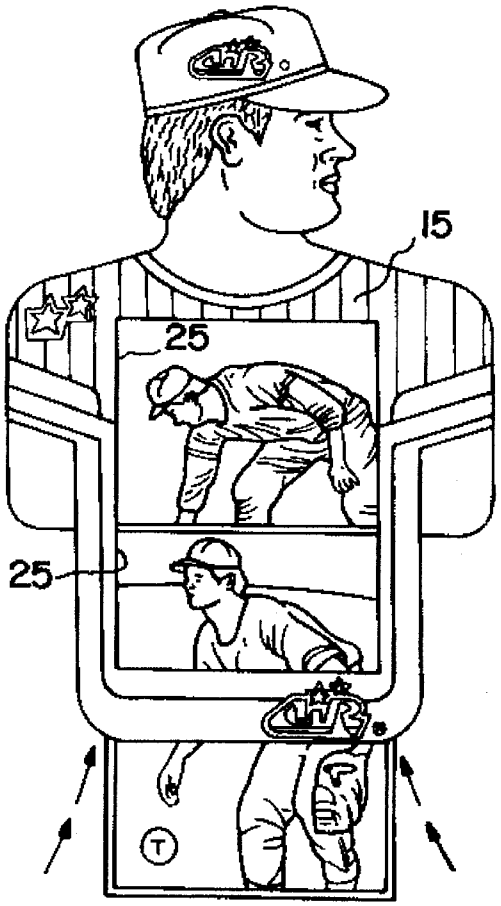
Figure 6:
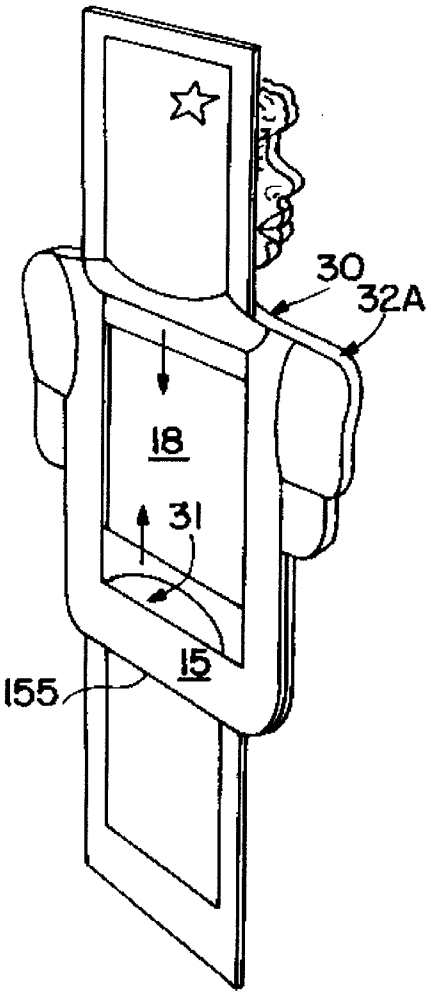
Figure 9:
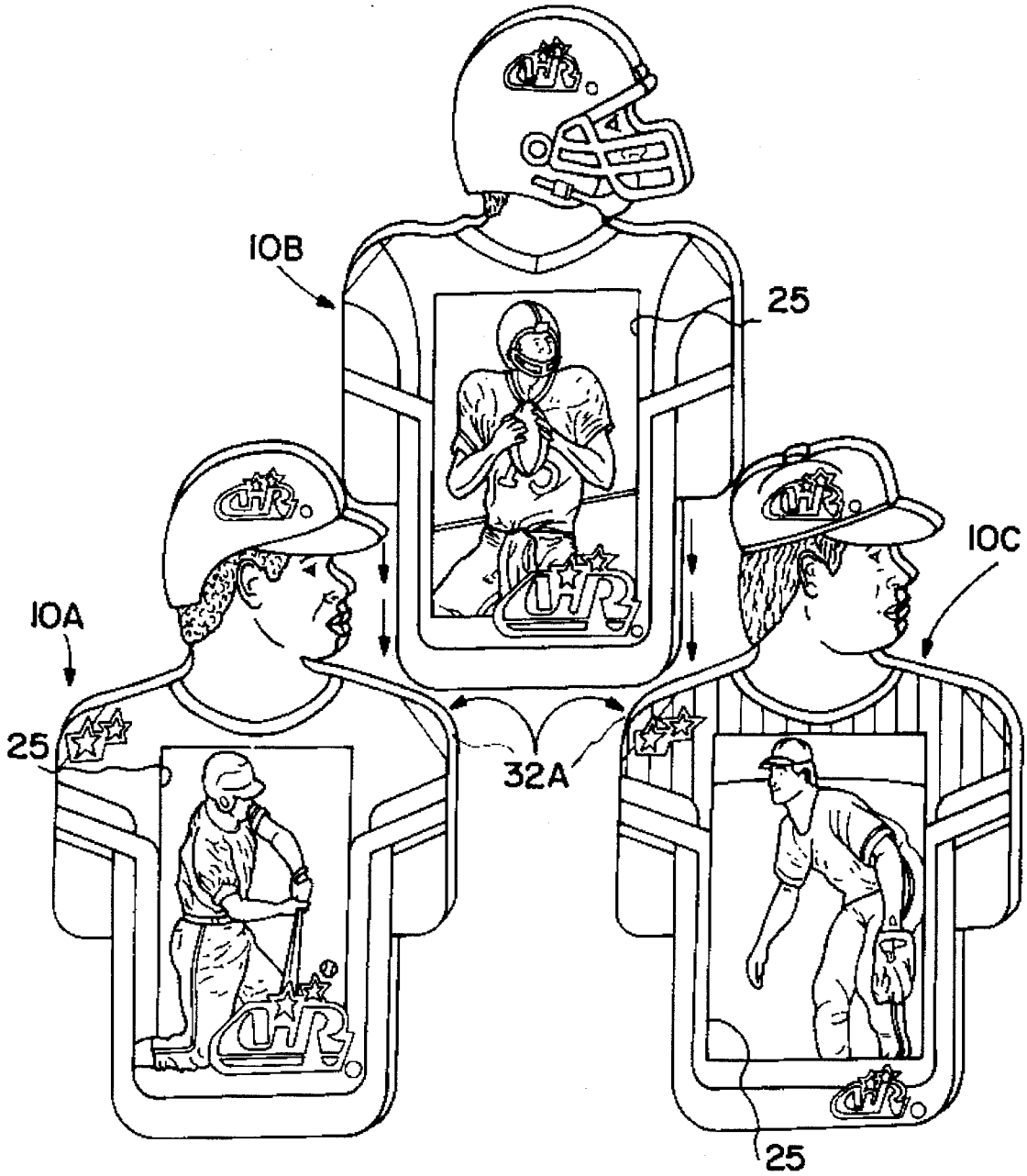
FIG. 9 shows three of the holders, illustrating the temporary attachment of the cards at the base and shoulder regions thereof.
Figure 10:
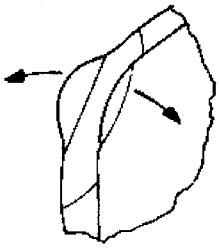
FIG. 10 is an enlarged detail view showing the slot configuration at one upper side (e.g. shoulder) for receiving parts of another holder.
Figure 11:
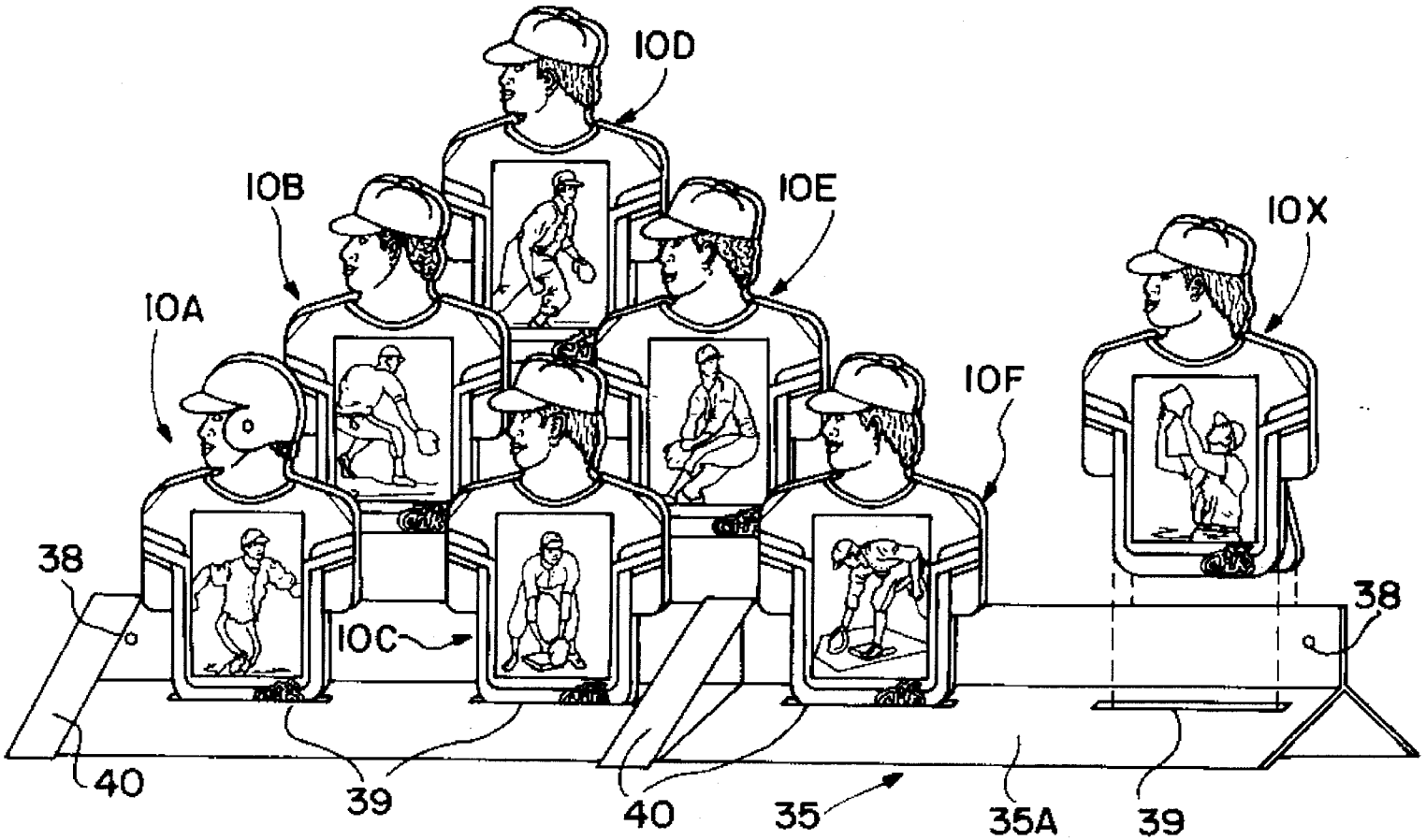
FIG. 11 illustrates a partially assembled grouping of the holders, with one holder in preparatory position to be added to a multi-purpose base.

In either embodiment, the attachment slots 32A, 32B are constructed and arranged to receive and retain an edge of the perimeter of another such holder 10B, or to receive at least one edge of one of the panels (plies) making up the other holder. By inserting edges of one holder 10A into attachment slots of an adjoining holder 10B, it is possible to construct a group display (as of a "team" of players depicted on the several mounted cards) such as shown in FIGS. 9 and 11. While it is possible to secure the holders 10A . . . 10X in a permanent configuration, the preferred form of the invention uses the attachment as a temporary arrangement which can be re-arranged or disassembled, in whole or in part, to substitute or add other player cards in like holders but in different displays, as may be chosen. FIGS. 9 and 10 show such an attachment where the "shoulder" center panel 18, and front panel 15 is folded onto and fastened to back panel 16. The panels, thus folded upon each other and secured, form the display holder seen in FIGS. 1–5 which can receive standard sports cards as shown in FIGS. 6–8, or which can itself be a collectible card. The adhesive pattern 28, as shown in FIG. 4, is such that the front and center panels 15, 18 are partially attached, leaving an entry/egress slot 30 behind the top 15A of front panel 15, and preferably another entry-egress slot 31 at the bottom 15B of front panel 15, for insertion or removing of cards (FIGS. 6–8), and also leaving one or more attachment slots 32A, 32B about the perimeter of the holder and extending part way between the panels.

This three panel integral blank embodiment is preferred from the standpoint that all printing can be done on one side of the blank, and the adhesive applied of the other side of the blank. The printing may include generic representations of players, such as baseball catchers (with mask, etc.), pitchers, fielders, and/or batters. FIG. 3 illustrates an example of such printing applied to the other side of the blank. When the panels of such a display holder are folded and adhered as explained, front panel 15 will overlie back panel 16, and the outlined depiction of a player will be seen through the aperture 25. The depictions of the player's head will align, and the display holder will have illustration both on its from and back. Using paperboard or card stock having a thickness of about 0.015 inch, the three panels define a holder space around the aperture 25, which space readily accommodates the edges of a typical sports card, which may be inserted/removed via slots 30 or 31. The picture of the player on such card appears fully in space 25, covering the aforementioned generic depiction on panel 18.

Alternatively, if the articles are to be used as a merchandisable substitute for present collectible cards, the of the panels of the article can be embossed to facilitate insertion of a corner of the bottom edges 15B, 16B, 18B, into the resulting space at the shoulder edge. This forms a friction fit attachment of the articles, especially when they are assembled in multiples as shown. It is apparent that various types of groups can be temporarily built up, modified, and disassembled, offering a wide variety of arrangements to the card collector.

Figure 15:
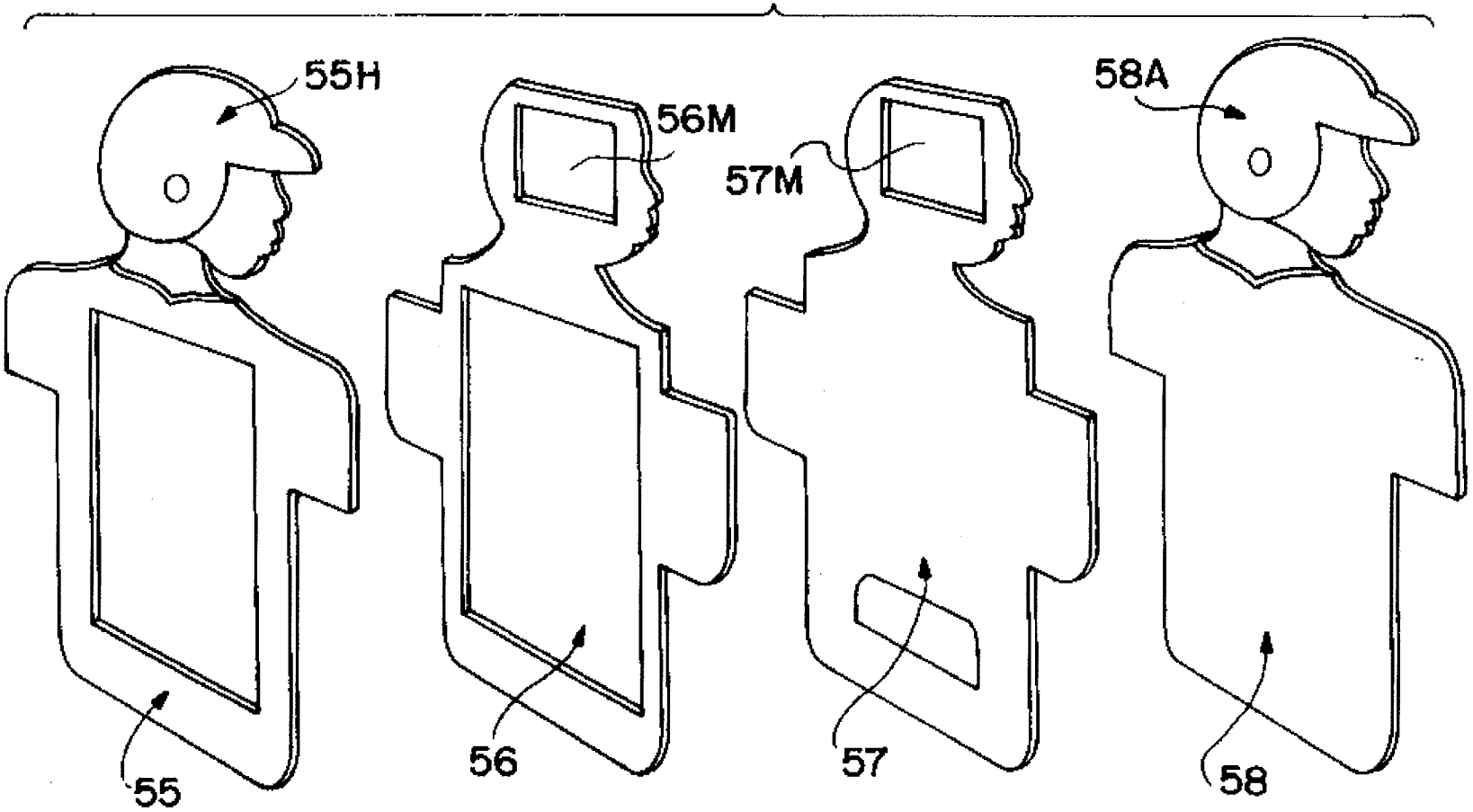
FIG. 15 is an exploded view showing a modified card holder employing four individual panels which combine into a display holder, and also showing exchangeable components therefor.

FIG. 15 shows another embodiment of the invention in which there are four panels, front panel 55, center panels 56 and 57, and a back panel 58. The depiction of a head on center panels 56 and 57 is truncated and integral with those respective panels. The panels are selectively adhered to each other in the same type of adhesive pattern as shown in FIG. 3. A further modification is provided by fitting the central panels 56, 57 with apertures 56A, 57A to receive small magnetic squares 55M, 58M. The actual head depictions 55H, 58H are separate pieces of board, fitted with small plies of a ferrous metal foil which can thus be held to the magnetic squares in the central panels. This embodiment provides the option to use a common shape of panel for a number of different sports player depictions, and to have interchangeable head depictions of different shape.

A base 35 is provided with a lengthwise upper edge to receive the bottom edges of the lowermost cards in the group, as shown in FIG. 11–14. The preferred form of base is built from an elongated member (e.g. paperboard) having a front panel 35A, a bottom panel 35B, a rear panel 35C, and a flap 35F which is hinged to rear panel 35C and adhered to the upper part of front panel 35A. Flap 35F extends approximately midway front panel 35A, ending at a fold line 36. Bottom panel 35B, and the adjoining lower parts of panels 35A and 35C, are of about the same width, so the bottom panel can form a support for the base (as in FIGS. 11, 12 and 14), or can be folded forward and exposed (as in FIG. 13) if base 35 is to be supported by pins or hooks (not shown) passed through holes 38.

Figure 12:
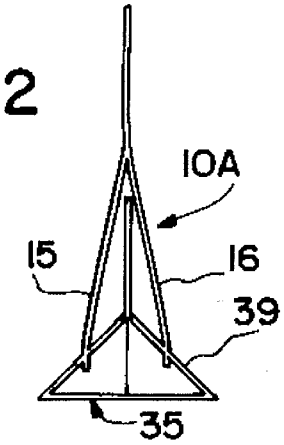
FIG. 12 is a cross-sectional view showing one card holder fitted to the base.
Figure 13:
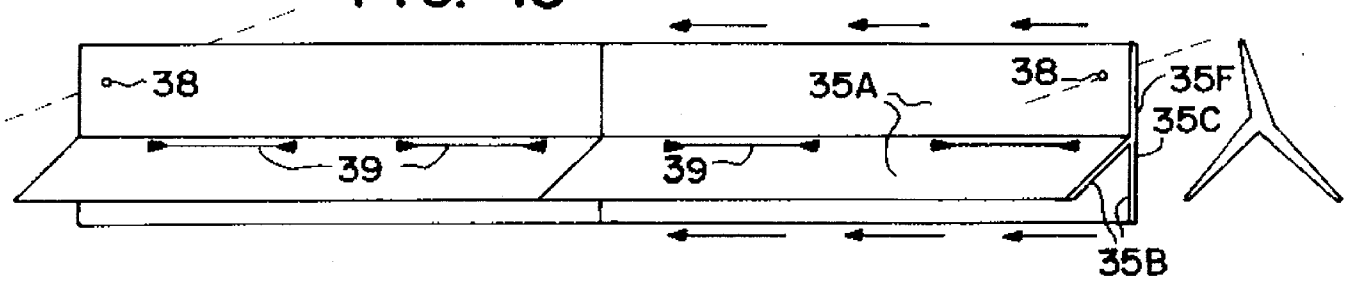
FIGS. 13 and 14 illustrate optional positions for use of the base.
Figure 14:
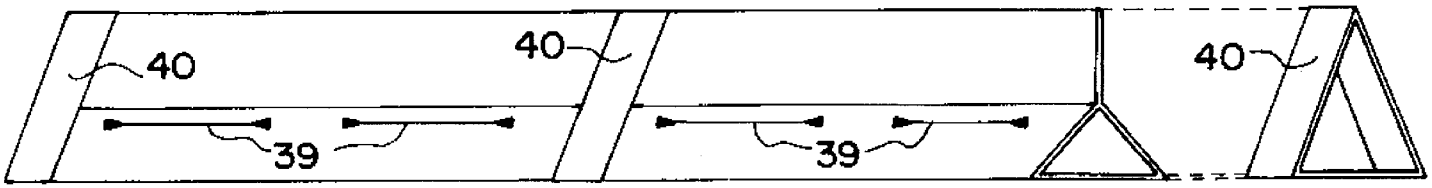

The base structure includes spaced apart slits or slots 39 which are of a width sufficient to receive the bottom edge of the front and back panels of an article, as seen in FIG. 12. Thus, the lowermost of the articles in an assembled display (as in FIG. 11) interlock with the base 35 and this arrangement can be built upon as the articles are assembled. If the articles are to be hung, with base 35 in the configuration of FIG. 13, then appropriate pins or hooks can be inserted at ends of the base (see dash centerlines) and the bases of the articles will engage into only one of the slots 38. If the base is used as in FIGS. 11 and 14, then its triangular shape is maintained by several triangular surrounding bands 40, and the bottoms of the article panels insert into front and back slots 38 as seen in FIG. 12.

An optional base (not shown) can be made of wood, plastic, or the like, built with a generally triangular cross-section, and having an elongated slot along its upper edge for receiving the lower edges of an assembly of articles.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. An article for display of collectible information or cards bearing such information, said article comprising a body including a front panel and a back panel connected together to define a space therebetween, said panels having a top, a bottom, and sides all of corresponding dimensions and defining the perimeter of said body;

said front panel having an aperture for viewing of a depiction on said back panel or through which a depiction on a separate card can be viewed when fitted into said space;

edge portions of said panels around the perimeter of said body being separable to define attachment slots which will receive therebetween at least a portion of one edge of a panel of a like article for linking the articles to each other;

whereby such articles can be linked together into an assembly, and such assembly supported as a common display.

2. An article as defined in claim 1, wherein said front panel and said back panel are formed from a blank of sheet material, a fold line between said panels defining an integral connection along which said front and back panels are hinged together, each of said panels having sides, a top, and a bottom, at least part of said sides of said panels being attached together leaving an access slot therebetween for inserting and withdrawing a card between said panels, additional unattached portions of the perimeter of said panels leaving interlock slots about said perimeter into which portions of the perimeter of the panels of another article can be inserted for attaching the articles temporarily to each other.

3. A set of interengaging articles for display of collector card information, each article comprising a body including a front and a back defining therebetween a holding space, a top, a bottom, and sides defining the perimeter of said article;

said front having an aperture through which a depiction can be viewed in said holding space; and means on the perimeter of said article for linking the articles to each other whereby such articles link together into an assembly supported as a common display.

4. An article as defined in claim 3, further including means for providing entry and exit of a card into and from said holding space;

whereby related cards can each be placed in an article, such articles linked together into an assembly display of the cards.

5. A set of articles as defined in claim 3, further including means on said articles' bottom providing a stand for holding said articles in a generally upright position.

6. A set of articles as defined in claim 3, wherein said body comprises a blank of sheet material and said front and back are separate front and back panels formed from said material and a fold line defining an integral connection along which said front and back panels are connected, each of said panels having sides, a top, and a bottom, at least part of said sides of said panels being attached together leaving an access slot therebetween for inserting and withdrawing a card between said panels and leaving interlock slots into which portions of the perimeter of the attached panels of another article can be inserted to attach the articles temporarily to each other.

7. A set of articles as defined in claim 3, wherein said blank includes front, back, and center panels having integral side connections defining fold lines about which the front and back panels can be folded against said center panel, the sides of said front, back, and center panels being selectively adhered leaving interlock slots at the side edges of the articles into which parts of additional articles can be inserted to assemble the multiple articles into a common display.

8. A set of articles as defined in claim 7, further including one of said front and back panels having a flap formed therein and movable against said center panel to spread the bottom portions of the panels apart and form a support base for free standing of the article.

9. A set of articles as defined in claim 3, further including a base member having front, bottom and rear base panels, and a flap hinged to said rear base panel, said base panels being of approximately equal length and of a thickness to interfit with separated bottom edges of the panels of the assembled articles.

10. A set of articles as defined in claim 9, wherein slots are formed in at least said front base panel to receive the bottom edges of panels of the assembled articles.

11. A set of articles as defined in claim 9, wherein said base panels are movable into a triangular configuration for free standing of said base member and into a T-shaped configuration for hanging of said base member.

12. A set of articles as defined in claim 9, including a plurality of triangular bands fitted about said base panels to hold said base panels in a free standing triangular configuration.

* * * * *